US009882258B2

(12) United States Patent
Carmon et al.

(10) Patent No.: US 9,882,258 B2
(45) **Date of Patent: *Jan. 30, 2018**

(54) MULTIPLE WAVEGUIDES EMBEDDED AROUND THE PERIPHERY OF A CHIP TO PROVIDE SIMULTANEOUS DIRECT TRANSITIONS BETWEEN THE CHIP AND THE MULTIPLE WAVEGUIDES

(71) Applicant: Semiconductor Components Industries, LLC, Phoenix, AZ (US)

(72) Inventors: Roi Carmon, Nesher (IL); Danny Elad, Moshav Liman (IL); Noam Kaminski, Kiryat Tivon (IL); Ofer Markish, Nesher (IL); Thomas Morf, Gross (CH); Evgeny Shumaker, Nesher (IL)

(73) Assignee: SEMICONDUCTOR COMPONENTS INDUSTRIES, LLC, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/062,239

(22) Filed: Mar. 7, 2016

(65) Prior Publication Data

US 2016/0190670 A1 Jun. 30, 2016

Related U.S. Application Data

(63) Continuation of application No. 14/583,715, filed on Dec. 28, 2014, now Pat. No. 9,564,671.

(51) Int. Cl.
*H01P 5/107* (2006.01)
*H01P 5/10* (2006.01)

(52) U.S. Cl.
CPC ..... *H01P 5/107* (2013.01); *H01P 5/10* (2013.01)

(58) Field of Classification Search
CPC ..... H01P 5/107
USPC ..... 333/26
See application file for complete search history.

(56) References Cited

U.S. PATENT DOCUMENTS 5,528,074 A * 6/1996 Goto et al. ..... H01L 23/66 257/664
5,808,519 A * 9/1998 Gotoh et al. ..... H01L 23/66 333/247
5,982,250 A * 11/1999 Hung et al. ..... H01L 23/49822 257/E23.062
7,348,864 B2 * 3/2008 Choudhury et al. .... H01L 23/66 333/24 R (Continued)

OTHER PUBLICATIONS

Michael C. Wanke., "Integrated chip-scale THz technology", Conference vol. 8031 ,Micro- and Nanotechnology Sensors, Systems, and Applications III Orlando, Florida, USA | Apr. 25, 2011, Can be found at: http://proceedings.spiedigitallibrary.org/proceeding.aspx?articleid=1350857.

(Continued)

*Primary Examiner* — Benny Lee
(74) *Attorney, Agent, or Firm* — Ramey & Schwaller, LLP

(57) ABSTRACT

An apparatus providing a direct chip to waveguide transition, comprising: one or more waveguides, a chip partially embedding each of the waveguides at a transition area positioned at a narrow side of each waveguide, and a transmitting element disposed at each of the transition areas, thereby providing one or more simultaneous, direct transitions between the chip and the waveguides.

13 Claims, 7 Drawing Sheets

(56) References Cited

U.S. PATENT DOCUMENTS

| | | | | |
|---|---|---|---|---|
| 8,552,813 | B2 | 10/2013 | Gritters et al. | |
| 9,564,671 | B2 * | 2/2017 | Carmon et al. | H01P 5/107 |
| 2007/0229186 | A1 * | 10/2007 | Hacker et al. | H01P 5/1007 333/125 |
| 2009/0219107 | A1 * | 9/2009 | Woods et al. | H01P 5/107 333/32 |
| 2011/0057741 | A1 * | 3/2011 | Dayan et al. | H01P 5/107 333/26 |
| 2012/0068316 | A1 | 3/2012 | Ligander | |
| 2013/0075904 | A1 | 3/2013 | Cho et al. | |
| 2013/0256850 | A1 | 10/2013 | Danny et al. | |
| 2014/0125425 | A1 | 5/2014 | Shen et al. | |

OTHER PUBLICATIONS

Hurm V., "A 243 GHz LNA Module Based on mHEMT MMICs With Integrated Waveguide Transitions", Microwave and Wireless Components Letters, IEEE (vol. 23 , Issue: 9 ), pp. 486-488, Jul. 2013.

Eray Topak., "Compact Topside Millimeter-Wave Waveguide-to-Microstrip Transitions", Microwave and Wireless Components Letters, IEEE, vol. 23, No. 12, pp. 641-643 , Dec. 2013.

Kavin Leong., K.M.K.H., "A 340-380 GHz Integrated CB-CPW-to-Waveguide Transition for Sub Millimeter-Wave MMIC Packaging", Microwave and Wireless Components Letters, IEEE, vol. 19, Issue: 6, pp. 413-415, Jun. 2009.

* cited by examiner

MULTIPLE WAVEGUIDES EMBEDDED AROUND THE PERIPHERY OF A CHIP TO PROVIDE SIMULTANEOUS DIRECT TRANSITIONS BETWEEN THE CHIP AND THE MULTIPLE WAVEGUIDES

CROSS-REFERENCE TO RELATED APPLICATIONS

This application is a continuation of U.S. Pat. No. 9,564,671, filed Dec. 28, 2014, issued Feb. 7, 2017, titled "DIRECT AND COMPACT CHIP TO WAVEGUIDE TRANSITION", and which is hereby incorporated herein by reference as though fully set forth herein.

FIELD OF THE INVENTION

The invention relates to the field of waveguides and integrated circuits.

BACKGROUND

Typical chip to waveguide transitions require communicating through a transmission line (TL), such as provided on a printed circuit board (PCB), that result in lossy connections between the chip, TL, and PCB. Although flipchip configurations providing transmission capability through one or more solder bumps can reduce signal loss somewhat, as operating frequencies increase above 150 GHz, the approach becomes inefficient as well.

The following table illustrates typical losses of some known chip to waveguide communications systems operating around 100 GHz in a flipchip configuration:

| Chip to PCB average In-band losses | 8 mm PCB TL average In-band losses | PCB to WG average In-band losses | Total average In-band losses |
|---|---|---|---|
| 0.7 dB | 1.8 dB | 0.5 dB | 3 dB |

Additionally, current solutions for chip to waveguide transitions occupy a significant amount of chip and PCB real estate.

The foregoing examples of the related art and limitations related therewith are intended to be illustrative and not exclusive. Other limitations of the related art will become apparent to those of skill in the art upon a reading of the specification and a study of the figures.

SUMMARY OF THE INVENTION

The following embodiments and aspects thereof are described and illustrated in conjunction with systems, tools and methods which are meant to be exemplary and illustrative, not limiting in scope.

There is provided, in accordance with an embodiment, an apparatus providing a direct chip to waveguide transition, comprising: one or more waveguides; a chip partially embedding each of the waveguides at a transition area positioned at a narrow side of each waveguide, and a transmitting element disposed at each of the transition areas, thereby providing one or more simultaneous, direct transitions between the chip and the one or more waveguides.

In some embodiments, a thinned periphery of the chip comprises at least a portion of each of the transition areas.

In some embodiments, a thickness of the thinned periphery of the chip is approximately 200 microns.

In some embodiments, the transmitting element comprises a ring antenna that is disposed at the thinned periphery of the chip.

In some embodiments, the transmitting element comprises a tapered slot passage providing wideband signal transmission capability.

In some embodiments, the transition area further comprises a substrate layer that is electrically connected to the thinned periphery of the chip, and galvanically connected to the waveguide.

In some embodiments, the tapered slot passage comprises a first portion disposed at the thinned periphery of the chip, and a second portion disposed at the substrate layer.

In some embodiments, a size of the chip is in an order of 6 mm×6 mm.

In some embodiments, a combined size of the chip and the substrate layer is 16 mm×16 mm.

In some embodiments, the chip is configured to operate at frequencies in the order of 100 GHz.

In some embodiments, the narrow side of the waveguide is 0.8 mm.

In some embodiments, the direct chip to waveguide transition further comprises a balun configured to balance a signal between the transmitting element and a drive circuit of the chip.

In some embodiments, the direct chip to waveguide transition further comprises a tuning element configured with the transmitting element to adjust a frequency response of the transmitting element to suit a signal transmitted via the waveguide.

In addition to the exemplary aspects and embodiments described above, further aspects and embodiments will become apparent by reference to the figures and by study of the following detailed description.

BRIEF DESCRIPTION OF THE FIGURES

Exemplary embodiments are illustrated in referenced figures. Dimensions of components and features shown in the figures are generally chosen for convenience and clarity of presentation and are not necessarily shown to scale. The figures are listed below.

DETAILED DESCRIPTION OF THE INVENTION

A solution is presented for providing direct chip to waveguide signal transmission and reception for the millimeter-wave domain, and that is compatible with standard semiconductor technologies, such as Silicon complementary metal-oxide-semiconductor (Si CMOS), and silicon-germanium bipolar CMOS (SiGe BiCMOS). The presented solution reduces loss and provides for smaller system packaging. A chip is provided with multiple direct transitions to multiple waveguides, allowing for simultaneous transmission and reception of high quality, low loss signal to and from multiple waveguides while occupying a smaller region on a PCB, substrate or other such platform.

In one embodiment, an edge of the chip that is coupled with the waveguide may be thinned using an etching process, thereby reducing signal loss.

Figure 1:
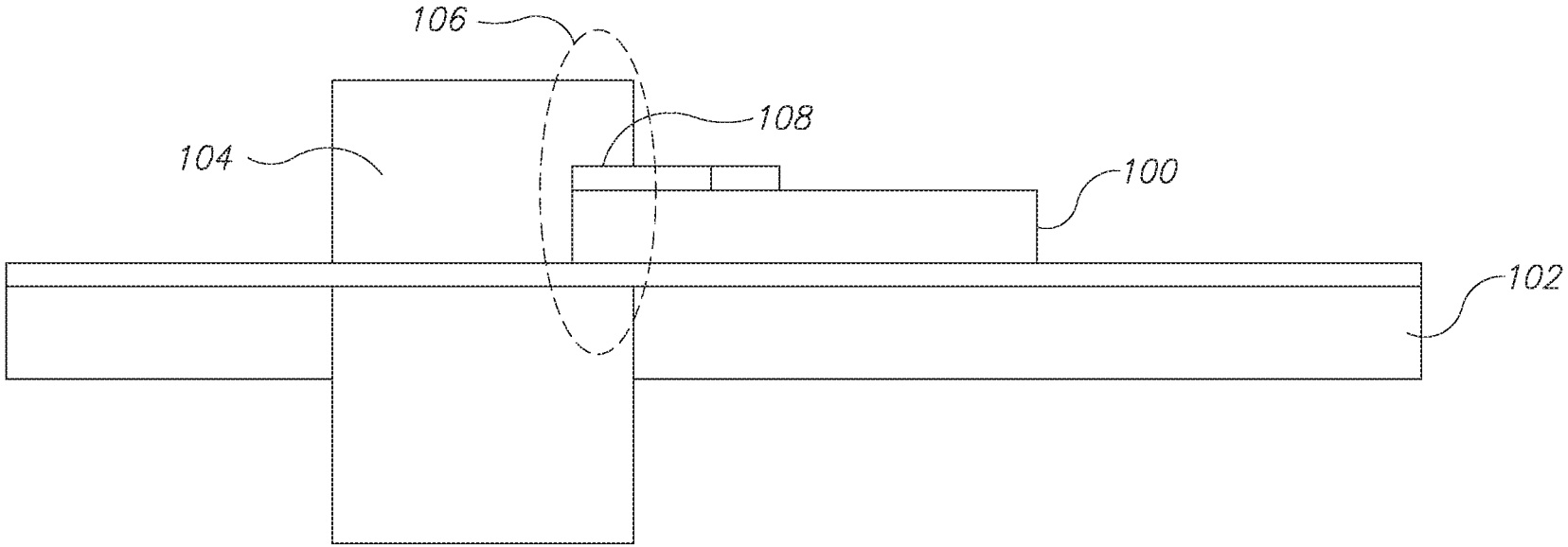
FIG. 1 is a simplified conceptual illustration of a cross-sectional view of a direct chip to waveguide transition, in accordance with an embodiment of the invention.

Reference is made to FIG. 1 which shows a simplified conceptual illustration of a cross-sectional view of a direct chip to waveguide transition, in accordance with an embodiment of the invention. For clarification purposes, FIG. 1 illustrates a single chip to waveguide transition. However, the invention disclosed herein equally applies to multiple transitions to multiple waveguides from a single chip.

A semiconductor chip 100 may be mounted on a substrate 102 to partially embed one or more waveguides 104 at one or more transition areas 106 positioned at a narrow side of each of the waveguides. A transmitting element 108 may be disposed at each of transition areas 106 to provide multiple simultaneous, direct transitions between chip 100 and one or more waveguides 104. Thus, chip 100 may directly transmit and receive multiple signals from multiple waveguides 104 simultaneously via multiple transmitting devices 108.

In an embodiment, at least a portion of transition area 106 may comprise a periphery of chip 100 that may be thinned in the order of 200 microns.

In an embodiment, the width of the narrow side of waveguide 104 may be approximately 0.8 mm, which is about 40% smaller than the width of standards waveguides. The bottom and upper backshorts of waveguide 104 may be metallic plated cavities, alternatively they may be made of multilayer substrate with peripheral vias.

In an embodiment, chip 100 has no contact with a backshort of waveguide 104.

In an embodiment, chip 100 is directly embedded within waveguide 104 without a plastic molding encapsulating chip 100.

Figure 2A:
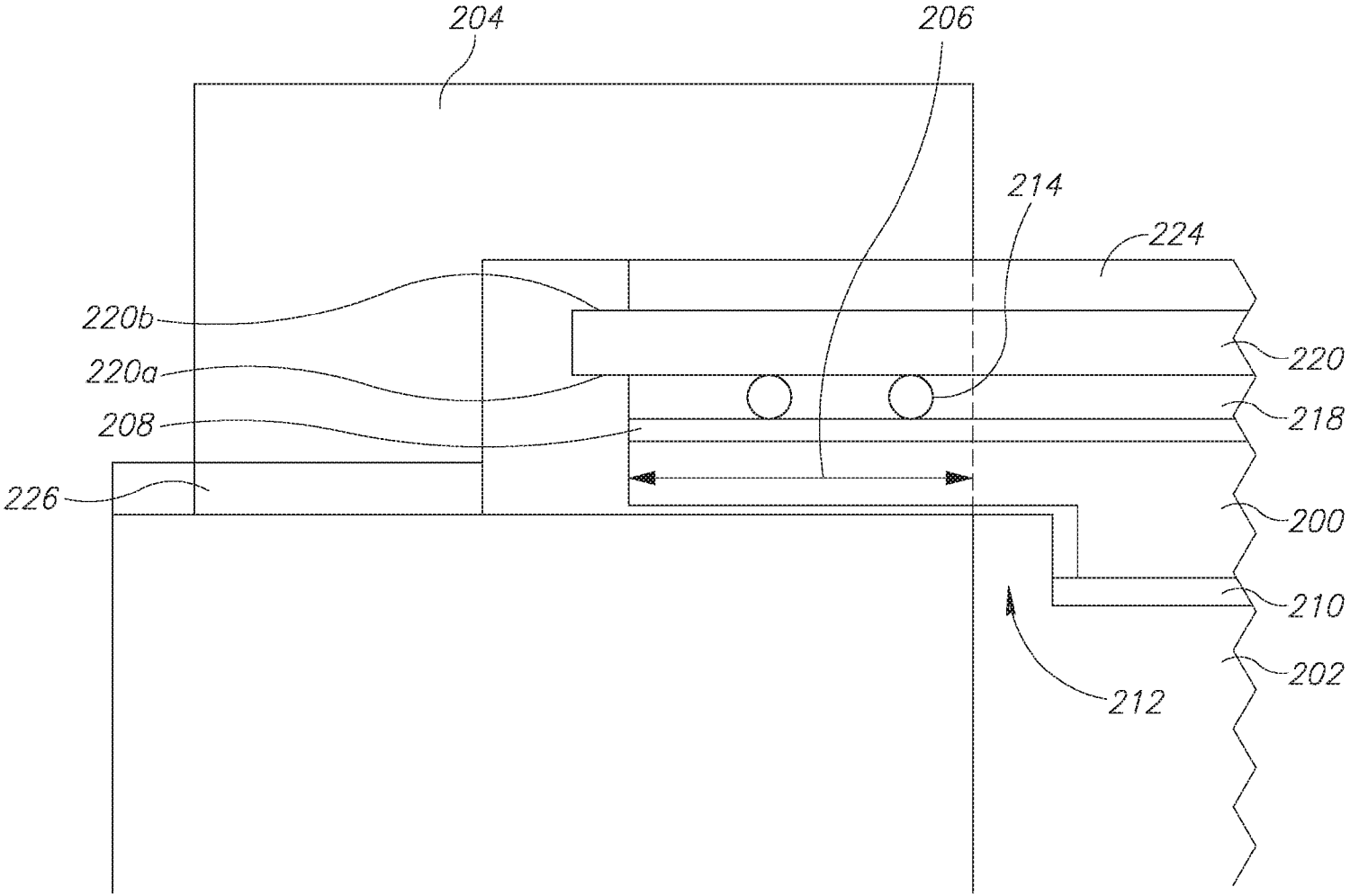
FIG. 2A is a simplified conceptual illustration of cross-sectional view of a direct chip to waveguide transition, in accordance with another embodiment of the invention.

Reference is now made to FIG. 2A which is a simplified conceptual illustration of a cross-sectional view of a direct chip to waveguide transition, in accordance with another embodiment of the invention. A chip 200 may be mounted on a substrate 202, such as with a thermal gel layer 210 at a platform 212 etched on substrate 202. A transition area 206, comprising a thinned periphery of chip 200, may be embedded within a waveguide 204. Chip 200 may be standard mounted on substrate 202, or alternatively, chip 200 may have a 'flip-chip' architecture.

In an embodiment, the width of the surface of the thinned periphery of chip 200 does not exceed 1 mm. A transmitting device 208 may be disposed at transition area 206, thereby embedding transmitting device 208 within waveguide 204. Transmitting device 208 may comprise an antenna for converting an electric signal to an electromagnetic signal for transmitting in waveguide 204.

Chip 200 may be electrically connected to waveguide 204 via a substrate layer 220 that may be fastened to waveguide 204 with a conducting glue layer 224. One or more conductive chip bumps 214 may be positioned within an underfill 218 connecting transmitting device 208 on chip 200 to a substrate metal bottom 220*a* and substrate metal top 220*b*, thereby providing electrical conductivity between transmitting device 208 and waveguide 204, allowing transmitting device 208 to radiate freely in the inner volume of waveguide 204. A shim 226 may be provided with waveguide 204 to provide mechanical strength and support. In an embodiment, waveguide 204 may be narrower at a portion situated above shim 226, and may be wider at a portion situated below shim 226, as shown in FIG. 2A. Alternatively, waveguide 204 may be of uniform width above and below shim 226.

Figure 2B:
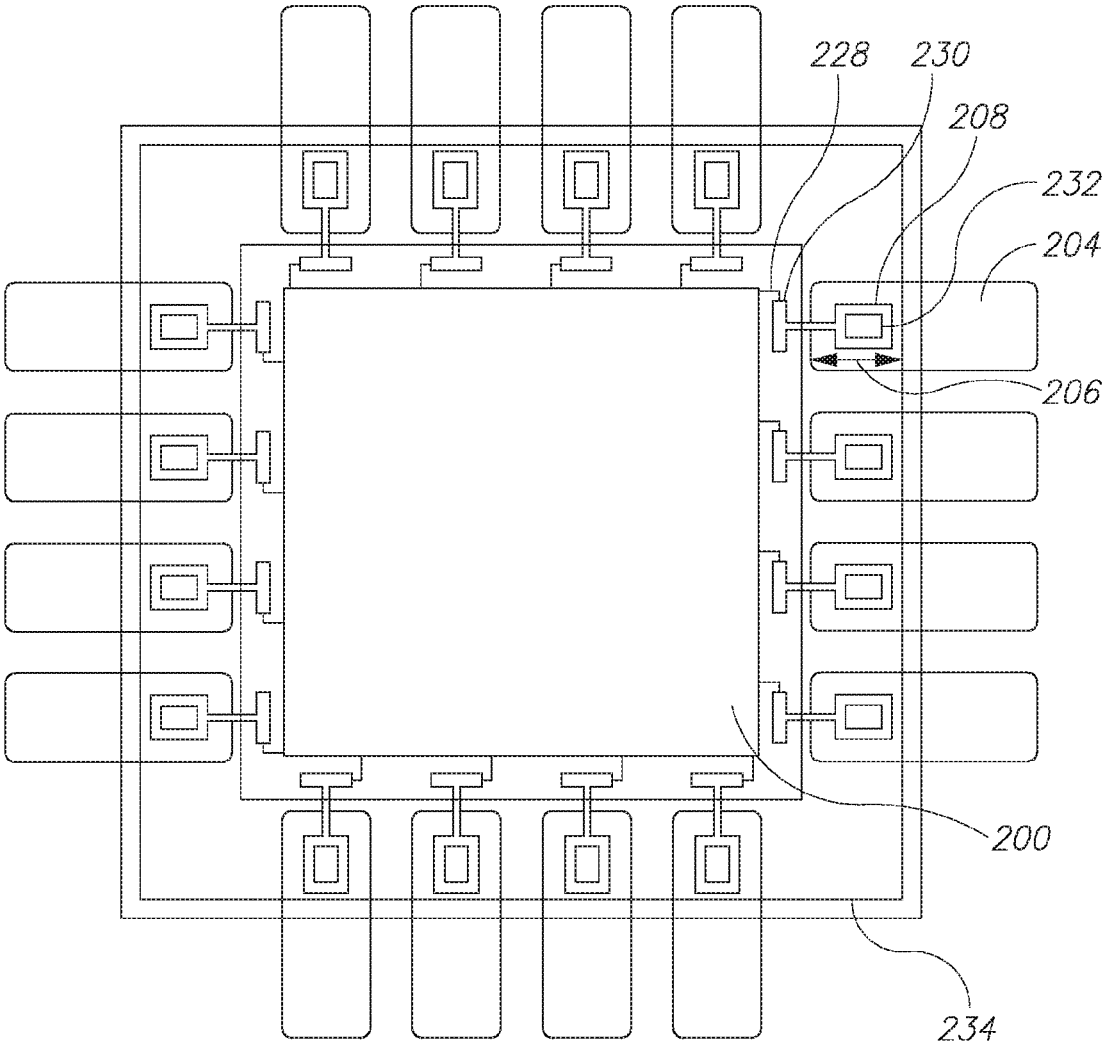
FIG. 2B is a simplified conceptual illustration of a top view of the direct chip to waveguide transition of the invention of FIG. 2A.

Reference is now made to FIG. 2B which shows a simplified top view of the direct chip to waveguide transition in accordance with an embodiment of the invention. Chip 200 may directly embed one or more waveguides 204 at one or more transition areas 206 comprising a thinned periphery of chip 200. Each of transition areas 206 may be disposed with a transmitting element 208, such as a differential ring antenna that may be configured to radiate autonomously into waveguide 204, thereby simultaneously embedding multiple transmitting elements 208 within multiple waveguides 204 and providing multiple, simultaneous direct chip to waveguide transitions in a compact manner with low signal loss.

For the purpose of simplicity, the following description of FIG. 2B will refer to a single direct chip to waveguide transmission. However, it is to be understood that the description equally applies to simultaneous direct single chip to multiple waveguide transmissions.

In an embodiment, waveguide 204 may have a rectangular, or oblong shaped cross-section for providing a narrow side of waveguide 204 for coupling to chip 200 via transition area 206, thereby allowing for a compact design to embed a relatively small portion of chip 200 within each waveguide 204. In this manner, multiple waveguides 204 may be coupled to a single chip 200. In some embodiments, the narrow side of the waveguide may range from 0.8 mm to 1.27 mm.

In an embodiment, a balun 230 coupled to a port 228 may be provided to balance an impedance load between a drive circuit of chip 200 and transmitting device 208, thereby increasing efficiency of signal transmission by reducing reflective loss.

Transmitting device 208 may comprise a differential ring antenna that may receive an electric signal from chip 200 via port 228 and balun 230, and convert the signal to an electromagnetic signal which is radiated directly into waveguide 204 at transition area 206. A tuning element 232 may be provided with antenna 208 to adjust a frequency response of antenna 208 to suit a signal transmitted via waveguide 204.

Similarly, antenna 208 may directly receive a radiated electromagnetic signal from waveguide 204 and convert it to an electric current for directly transmitting to chip 200. Antenna 208 may transmit the electric signal through balun 230 where it may be load balanced to the circuitry of chip 200. Chip 200 may receive the balanced electric signal at port 228 via metal top and bottom 220*a* and 220*b* and optionally bumps 214, shown in FIG. 2A. A chip ring 234 may be provided with chip 200.

In an embodiment, a signal may be fed to antenna 208 via ports that are oriented at 180 degrees from each other, thereby providing a differential nature to the antenna allowing robust transition to waveguide 204, as well as wideband transmission capability to antenna 208. In an embodiment, a single lead from chip 200 may be translated by balun 230 to two parallel leads that both are fed to antenna 208, providing antenna 208 with a differential signal that is orientated at 180 degrees. Alternatively, chip 200 may directly provide antenna 208 with a differential feed.

Figure 3B:
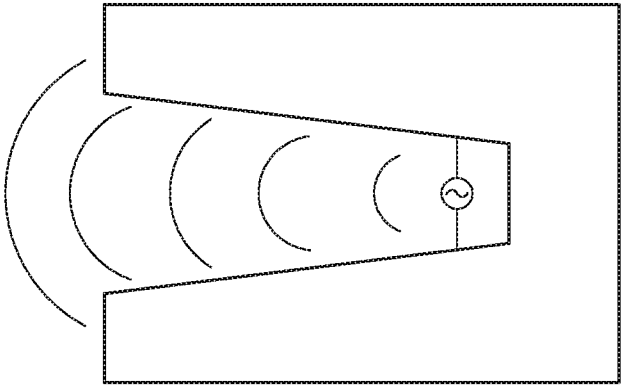
FIG. 3B is a simplified conceptual illustration of a tapered slot antenna configured for wide bandwidth operation and improved signal matching, operative in accordance with an embodiment of the invention.
Figure 3A:
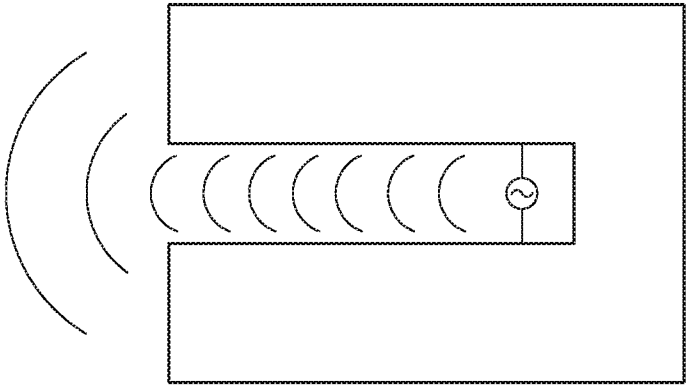
FIG. 3A is a simplified conceptual illustration of a regular slot antenna configured for narrow bandwidth operation, operative in accordance with an embodiment of the invention.

Reference is now made to FIGS. 3A-3B which illustrate two tapered slot passage elements for converting an electric signal to an electromagnetic signal, operative in accordance with an embodiment of the invention. The antenna illustrated in FIG. 3A comprises a regular slot passage for radiating a signal within a narrow-band transmission capability. By contrast, the geometry of a tapered slot passage illustrated in FIG. 3B may guide the waves of the converted electromagnetic signal from a small excitation area to a large aperture for efficient radiation over a range of frequencies in a waveguide, thereby providing wideband transmission capability.

Figure 3C:
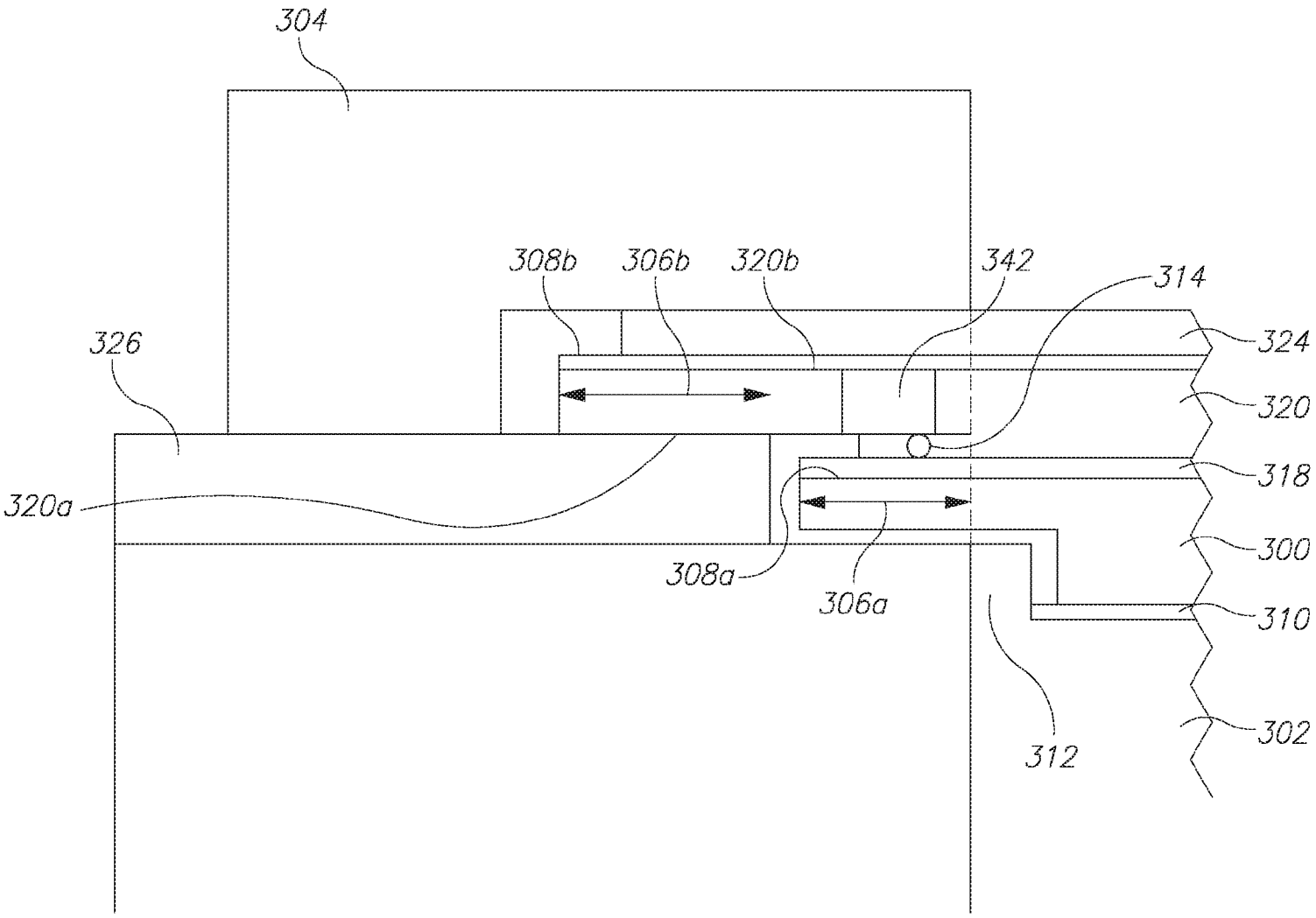
FIG. 3C shows a simplified conceptual illustration of a cross-sectional view of a direct chip to waveguide transition, in accordance with another embodiment of the invention.
Figure 3D:
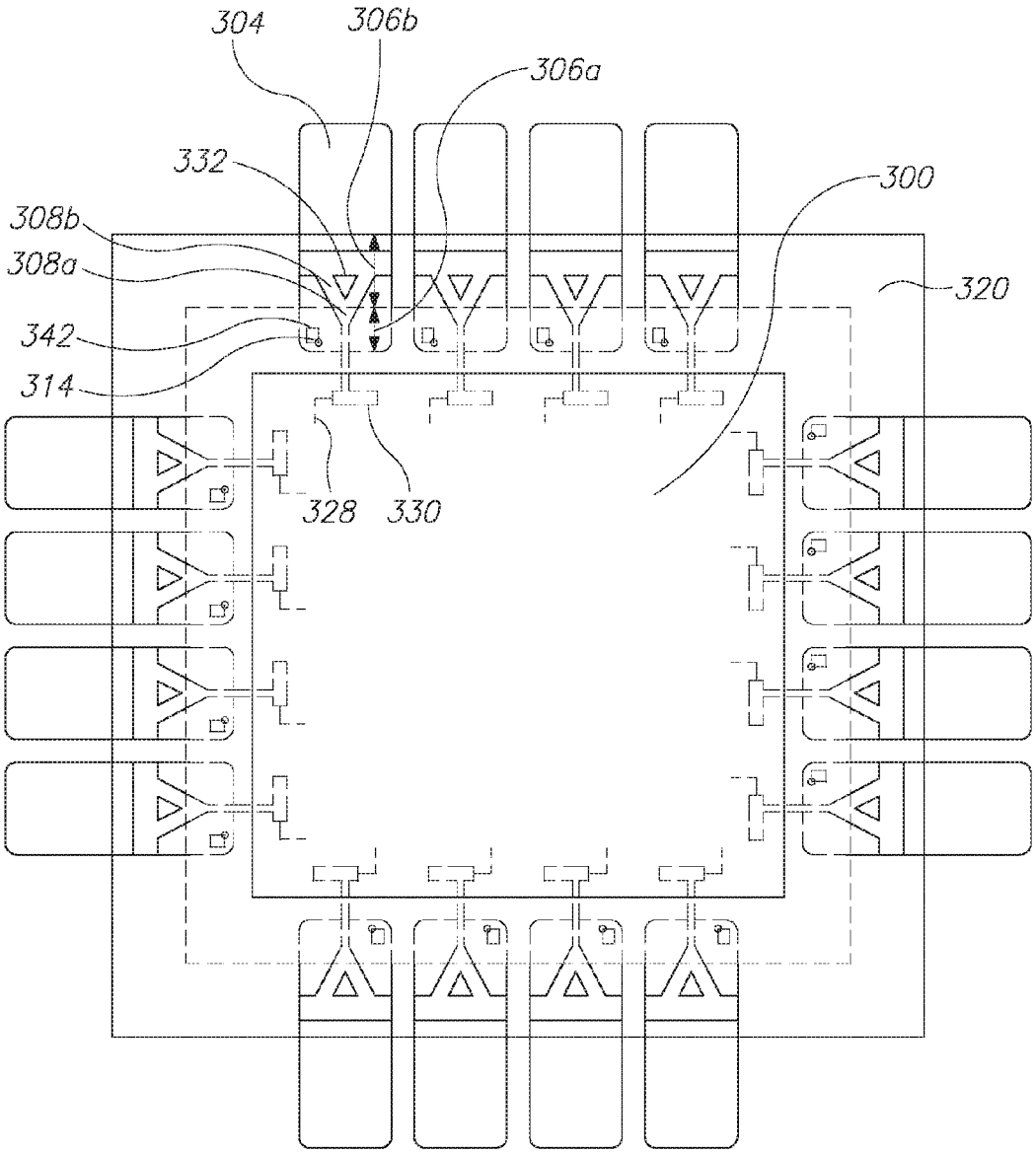
FIG. 3D is a simplified conceptual illustration of a top view of the direct chip to waveguide transition of the invention of FIG. 3C.

Reference is now made to FIGS. 3C-3D, which taken together, are a simplified conceptual illustration of another direct chip to waveguide transition, in accordance with an embodiment of the invention. A chip 300 may be mounted on a substrate 302, such as with a thermal gel layer 310 at a platform 312 etched on substrate 302. Chip 300 may be standard mounted on substrate 302, or alternatively, chip 300 may have a 'flip-chip' architecture and may be mounted on substrate 302 with one or more chip bumps 314, such as conductive solder bumps, that are optionally positioned within an underfill 318.

Chip 300 may directly embed one or more waveguides 304 at one or more transition areas comprising transition area pairs 306*a* and 306*b*. Transition area 306*a* may comprise a thinned periphery of chip 300, and transition area 306*b* may comprise a portion of a substrate layer 320 that is galvanically and electrically connected to waveguide 304 via a conductive metal top 320*b* and a conductive glue layer 324. Substrate layer 320 may be adjacent to and electrically connected to the thinned periphery of chip 300 via a conductive metal bottom 320*a*, bumps 314 and vias 342, thereby electrically connecting transition area pairs 306*a* and 306*b* to each other. In an embodiment, substrate layer 320 may be composed of alumina, aluminum nitride or any other ceramic or organic laminate.

Transitions area pairs 306*a* and 306*b* may together be provided with a transmitting element, such as a differential tapered slot passage providing wideband capability described in FIG. 3B, and comprising a chip transmitting portion 308*a* and a substrate transmitting portion 308*b*, as follows: chip transmitting portion 308*a* may be disposed at transition area 306*a* at the etched periphery of chip 300, and substrate transmitting portion 308*b* may be disposed at substrate layer 320, thereby galvanically connecting substrate transmitting portion 308*b* to waveguide 304. Transmitting element portions 308*a* and 308*b* may be electrically connected to the top and bottom portions of waveguide 304 and may together be configured to directly transmit a signal between chip 300 and waveguide 304, thereby providing wideband signal transmission between chip 300 and waveguide 304.

An electric signal received by transmitting element 308*a* from chip 300 may flow through bumps 314 to substrate metal bottom 320*a*, through via 342 to substrate metal top 320*b* to transmitting element 308*b*. Transmitting element 308*b* may convert the electric signal to an electromagnetic signal for transmission via waveguide 304.

A shim 326 may be provided with waveguide 304 to provide mechanical strength and support.

Reference is now made to FIG. 3D which shows a simplified top view of the direct chip to waveguide transition in accordance with an embodiment of the invention. Chip 300 may be directly connected to one or more waveguides 304 at transition area pairs 306*a* and 306*b*, thereby enabling multiple simultaneous compact and low loss transitions to multiple waveguides.

Each of transition area pairs 306*a* and 306*b* may be disposed with a transmitting element comprising pairs 308*a* and 308*b*, as described above, thereby simultaneously embedding multiple transmitting element pairs 308*a* and 308*b* within multiple waveguides 304 for providing multiple, simultaneous, wideband direct chip to waveguide communications.

For the purpose of simplicity, the following description of FIG. 3D will refer to a single direct chip to waveguide transmission. However, it is to be understood that the description equally applies to multiple simultaneous direct chip to waveguide transmissions.

Reference is now made to FIG. 3D which shows a simplified top view of the direct chip to waveguide transition of FIG. 3C. In an embodiment, waveguide 304 may have a rectangular, or oblong shaped cross-section for providing a narrow side of waveguide 304 for coupling to chip 300 via transition areas 306*a* and 306*b*, thereby allowing for a compact design to embed a relatively small portion of chip 300 within each waveguide 304. In this manner, multiple waveguides 304 may be coupled to a single chip 300. In some embodiments, the narrow side of the waveguide ranges from 0.8 mm to 1.27 mm.

Transmitting element pair 308*a* and 308*b* may together comprise a tapered slot passage transmitting element, enabling wideband operation, such as shown in FIG. 3A for converting an electrical signal originating from chip 300 to an electromagnetic signal for transmission via waveguide 304. Transmitting element 308*a* may comprise an on-chip tapered slot portion disposed at transition area 306*a* comprising the etched periphery of chip 300. Transmitting element 308*b* may comprise a substrate tapered slot portion disposed with substrate transition area 306*b* at substrate layer 320, where substrate tapered slot portion 308*b* may be galvanically connected to waveguide 304, thereby improving performance.

A tuning element 332 may be provided with tapered slot portion 308*b* to adjust the frequency response to suit a signal transmitted via waveguide 304.

In an embodiment, a balun 330 coupled to a port 328 may be provided to balance an impedance load between a drive circuit of chip 300 and transmitting elements 308*a* and 308*b*, thereby increasing efficiency of signal transmission by reducing reflective loss.

On-chip tapered slot portion 308*a* may receive an electric signal from chip 300 via balun 330 and port 228, and convey the signal to substrate tapered slot portion 308*b* via bumps 314, vias 342, metal bottom 320*a*, and metal top 320*b*, shown in FIG. 3C. Substrate tapered slot portion 308*b* may convert the signal to an electromagnetic signal, which may be optionally tuned by tuning element 332 and radiated directly into waveguide 304.

Similarly, substrate tapered slot portion 308*b* may directly receive at transition area 306*b* a radiated electromagnetic signal from waveguide 304 and convert it to an electric current for transmitting to chip 300. The signal may be conveyed via bumps 314, vias 340, metal bottom 320*a*, and metal top 320*b* to on-chip substrate tapered slot portion 308*a* disposed at transition area 306*a*, where it may flow through balun 330 for load balancing to the circuitry of chip 300.

In an embodiment, the combined size of chip 300 and substrate layer 320 may be approximately 16 mm×16 mm for operation at frequencies of approximately 100 GHz. In an embodiment the size of chip 300 without substrate layer 320 may be in the order of 6 mm×6 mm, and the width of etched portion of chip 300 providing transition area 306*a* may be in the order of 1 mm or less. Chip 300 and substrate layer 320 may be scaled accordingly for higher frequencies.

Figure 4:
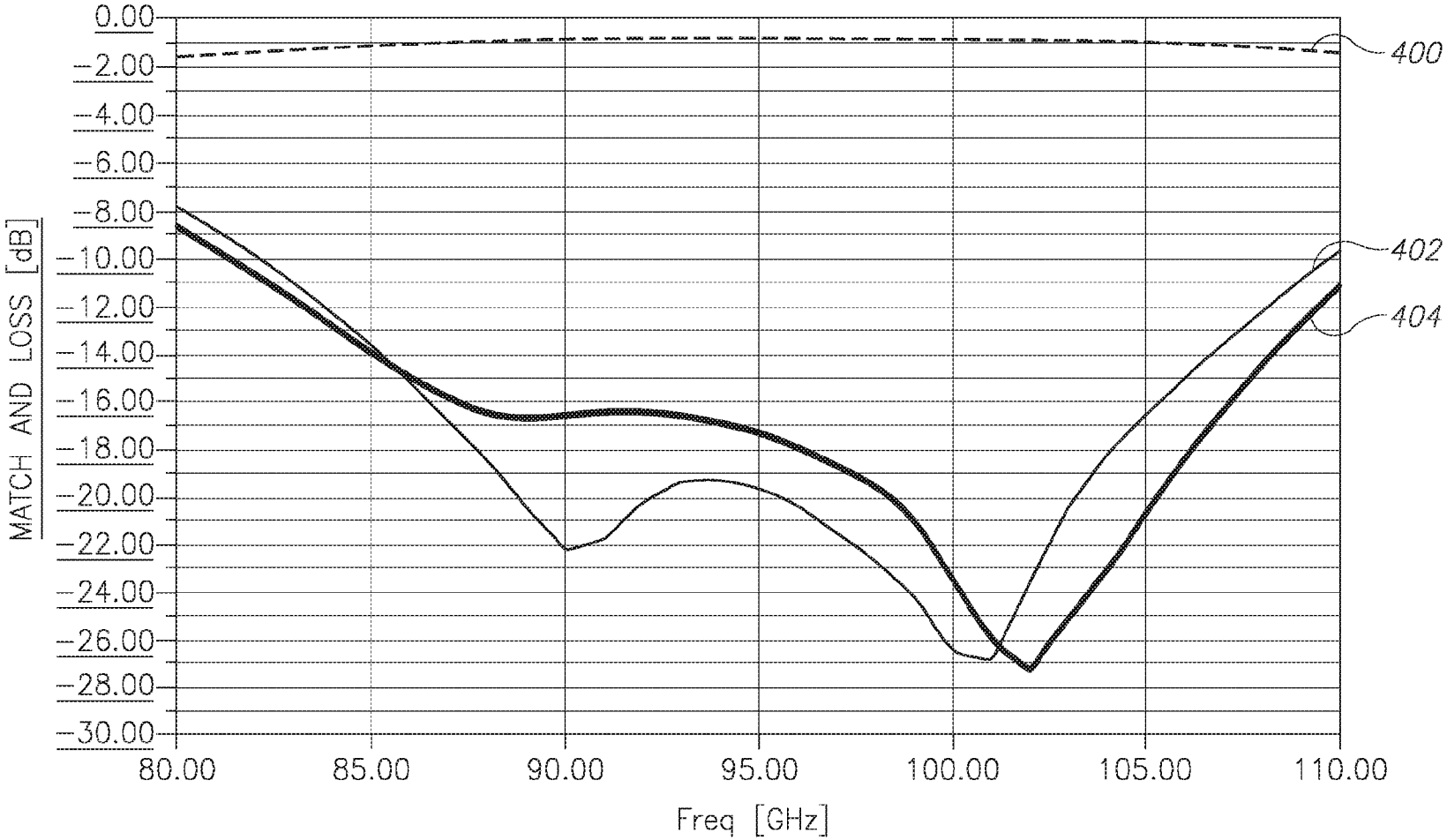
FIG. 4 illustrates the results of a performance simulation of a direct chip to waveguide transition, in accordance with an embodiment of the invention.

In this manner, a single chip may communicate simultaneously with multiple waveguides, providing compact size wafer level processing, and low signal loss. Reference is now made to FIG. 4, which illustrates the results of a performance simulation of a direct chip to waveguide transition, in accordance with an embodiment of the invention. Curve 400 illustrates simulated signal match and return loss in dB vs. frequency in GHz, showing performance results for multiple chip to waveguide transitions, in accordance with the system of FIGS. 3C-3D. It may be noted that without the inclusion of balun 330 of FIG. 3D, the performance may be expected to improve by approximately 0.5 dB. By contrast, curves 402 and 404 illustrate simulated signal return loss vs. frequency performances for prior art systems operating in wide-band frequencies.

Thus, the system disclosed herein provides improved performance for a single chip to waveguide transition, and additionally provides a single chip with multiple simultaneous direct chip to waveguide transition.

In the description and claims of the application, each of the words "comprise" "include" and "have", and forms thereof, are not necessarily limited to members in a list with which the words may be associated. In addition, where there are inconsistencies between this application and any document incorporated by reference, it is hereby intended that the present application controls.

What is claimed is:

1. An apparatus providing a direct chip to waveguide transition, comprising:

multiple waveguides;

a chip partially embedding two or more of said multiple waveguides along each of one or more edges of the chip, each of said multiple waveguides partially embedded by a respective transition area positioned at a narrow side of each waveguide where the narrow side runs perpendicular to the chip, and a respective transmitting element disposed at an embedded portion of the corresponding transition area in each of the multiple waveguides, each transmitting element comprising a respective antenna, the antennas collectively providing multiple simultaneous, direct transitions between said chip and said multiple waveguides.

2. The apparatus of claim 1, wherein a thinned periphery of said chip comprises at least a portion of each of said transition areas.

3. The apparatus of claim 2, wherein a thickness of said thinned periphery of said chip is approximately 200 microns.

4. The apparatus of claim 2, wherein each said antenna is a ring antenna that is disposed at said thinned periphery of said chip.

5. The apparatus of claim 2, wherein said respective transmitting element comprises a corresponding tapered slot passage providing wideband signal transmission capability.

6. The apparatus of claim 5, wherein a substrate layer is electrically connected to said thinned periphery of said chip, and galvanically connected to a respective one of said multiple waveguides of the corresponding transition areas.

7. The apparatus of claim 6, wherein said respective tapered slot passage comprises a first portion disposed at said thinned periphery of said chip, and a second portion disposed at said substrate layer.

8. The apparatus of claim 7, wherein a size of said chip is in an order of 6 mm ×6 mm.

9. The apparatus of claim 7, wherein a combined size of said chip and said substrate layer is 16 mm ×16 mm.

10. The apparatus of claim 7, wherein said chip is configured to operate at frequencies of approximately 100 GHz.

11. The apparatus of claim 1, wherein said narrow side of each of said multiple waveguides is 0.8 mm.

12. The apparatus of claim 1, further comprising a balun configured to balance a signal between each said transmitting element and a corresponding drive circuit of said chip.

13. The apparatus of claim 1, further comprising a respective tuning element configured with said corresponding said transmitting element to adjust a frequency response of said respective transmitting element to suit a signal transmitted via a corresponding one of said multiple waveguides.

* * * * *